US007850795B2

(12) United States Patent
Kawasaki et al.

(10) Patent No.: US 7,850,795 B2
(45) Date of Patent: Dec. 14, 2010

(54) BUILD-UP WEAR-RESISTANT COPPER ALLOY AND VALVE SEAT

(75) Inventors: Minoru Kawasaki, Toyota (JP); Takao Kobayashi, Seto (JP); Tadashi Oshima, Aichi-ken (JP); Kazuyuki Nakanishi, Seto (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 539 days.

(21) Appl. No.: 11/319,053

(22) Filed: Dec. 28, 2005

(65) Prior Publication Data

US 2006/0108029 A1 May 25, 2006

Related U.S. Application Data

(63) Continuation of application No. PCT/JP2005/001451, filed on Jan. 26, 2005.

(30) Foreign Application Priority Data

Mar. 15, 2004 (JP) ..... 2004-072967

(51) Int. Cl.
*C22C 9/06* (2006.01)

(52) U.S. Cl. ..... 148/414; 148/435; 420/487; 420/488

(58) Field of Classification Search ..... 148/414, 148/435; 420/487, 488
See application file for complete search history.

(56) References Cited

U.S. PATENT DOCUMENTS 5,188,799 A 2/1993 Mori et al.
5,843,243 A 12/1998 Kawasaki et al.
5,911,949 A 6/1999 Ninomiya et al.

FOREIGN PATENT DOCUMENTS

| | | |
|---|---|---|
| EP | 0 320 195 A | 6/1989 |
| EP | 0 505 172 A | 9/1992 |
| EP | 0 939 139 A | 9/1999 |
| EP | 1 120 472 A | 8/2001 |
| EP | 1 361 288 A | 11/2003 |
| JP | 01-152232 | 6/1989 |
| JP | 04-131341 | 5/1992 |
| JP | 04-297536 | 10/1992 |
| JP | 05-140678 | 6/1993 |

(Continued)

OTHER PUBLICATIONS

Tanaka et al., "Development of Laser Clad Valve Seat Alloys," Toyota Chuo Kenkyusho R&D Rebyu, X, XX, vol. 28, No. 3, pp. 35-45, Sep. 1, 1993.

*Primary Examiner*—Sikyin Ip
(74) *Attorney, Agent, or Firm*—Finnegan, Henderson, Farabow, Garrett & Dunner, LLP

(57) ABSTRACT

While securing the building-up ability and crack resistance, to provide a build-up wear-resistant copper alloy and valve seat. The build-up wear-resistant copper alloy and valve seat are characterized by having a composition of nickel: 5.0-24.5%, iron: 3.0-20.0%, silicon: 0.5-5.0%, boron: 0.05-0.5%, chromium: 0.3-5.0%, one member or two members or more selected from the group consisting of molybdenum, tungsten and vanadium: 3.0-20.0%, by weight %, and the balance being copper and inevitable impurities.

1 Claim, 12 Drawing Sheets

FOREIGN PATENT DOCUMENTS

| | | | |
|---|---|---|---|
| JP | 06 010081 | | 1/1994 |
| JP | 08-225868 | | 9/1996 |
| JP | 10-096037 | | 4/1998 |
| JP | 2984344 | B2 * | 11/1999 |
| JP | 20002/055748 | | 7/2002 |
| WO | WO 02/055748 | | 7/2002 |

* cited by examiner

BUILD-UP WEAR-RESISTANT COPPER ALLOY AND VALVE SEAT

This is a continuation of PCT application No. PCT/JP/2005/001451, filed Jan. 26, 2005, which in turn is based on Japanese Application No. 2004-72967, filed Mar. 15, 2004.

TECHNICAL FIELD

The present invention relates to a build-up wear-resistance copper alloy, especially, to a build-up wear-resistance copper alloy usable for valve seats of internal combustion engines, and the like.

BACKGROUND ART

Conventionally, as build-up wear-resistant copper alloys, beryllium copper in which beryllium is added to copper, or precipitation-hardening type alloys, such as a copper-nickel-silicon alloy known as the Colson alloy, dispersion-strengthened type alloys in which hard oxide particles, such as $Al_2O_3$, $TiO_2$ and $ZrO_2$, are dispersed in copper-based matrices, have been known. However, the precipitation-hardening type alloys are such that the hardness degrades sharply at an age-hardening temperature (350-450° C.) or more, further, since the sizes of precipitated particles are very fine so that they are a few am or less, large wear might occur under frictional conditions accompanying sliding, even though the hardness is high. Moreover, although some of the dispersion-hardened type copper-based alloys which are obtained by internal oxidation methods maintain high strength and hardness even at high temperatures, it is hard to say that they are good in terms of the wear resistance because the dispersion particles are minimally fine. In addition, some of the dispersion-strengthened types which are obtained by sintering methods are not adequate to build-up applications because the metallic structures have been changed by fusion, though it is possible to control the sizes of the dispersion particles.

Hence, copper-based alloys of good wear resistance have been proposed recently (Patent Literature No. 1 and Patent Literature No. 2), in copper-based alloys in which particles having hard Co—Mo-based silicides (silicide) are dispersed in soft Cu—Ni-based matrices. Since they secure wear resistance by the hard particles and simultaneously secure toughness by the matrices, they are adequate to alloys for building up using a high-density energy source, such as a laser beam. However, when intending to further improve the wear resistance and heightening the area rate of the hard particles, the crack resistance during building up degrades, and the bead cracks occur often.

In order to solve this, the present inventors focused their attention on that Co—Mo-based silicide is hard and brittle, and developed a wear-resistant copper-based alloy, which can not only enhance the wear resistance in high-temperature regions but also can enhance the crack resistance and machinability, by decreasing Co—Mo-based silicide, by increasing the proportions of Fe—W-based silicide, Fe—Mo-based silicide and Fe—V-based silicide, which have properties of exhibiting lower hardness and slightly higher toughness than the Co—Mo-based silicide, by decreasing the Co content and Ni content, and by increasing the Fe content and Mo content.

Further, as a copper-based alloy powder for laser building up, one, which has a composition containing 10-40% nickel and 0.1-6% silicon, and simultaneously a sum of one member or two members or more selected from the group consisting of aluminum, yttrium, a misch metal, titanium, zirconium and hafnium being 0.01-0.1%, 0.01-0.1% oxygen, and the balance being copper and inevitable impurities, has been known (Patent Literature No. 3).

Furthermore, as a copper-based alloy powder for laser building up, one, which has a composition containing 10-40% nickel and 0.1-6% silicon, and simultaneously 20% or less cobalt, a sum of molybdenum and/or tungsten being 20% or less, 20% or less iron, 10% or less chromium, 0.5% or less boron, a sum of one member or two members or more selected from the group consisting of aluminum, yttrium, a misch metal, titanium, zirconium and hafnium being 0.01-0.1%, 0.01-0.1% oxygen, and the balance being copper and inevitable impurities, has been known (Patent Literature No. 3).

Patent Literature No. 1: Japanese Unexamined Patent Publication (KOKAI) No. 8-225,868

Patent Literature No. 2: Japanese Examined Patent Publication (KOKOKU) No. 7-17,978

Patent Literature No. 3: Japanese Unexamined Patent Publication (KOKAI) No. 4-131,341

DISCLOSURE OF THE INVENTION

In accordance with the aforementioned prior arts, the wear-resistant copper alloys in which the hard particles having Co—Mo-based, Fe—Mo-based, Fe—W-based and Fe—V-based silicides are dispersed are good in terms of the wear resistance, and are fully completed practically. However, when building up using a high-density energy source, such as a laser beam, since the atmosphere is shut off, it is carried out while flowing an inert gas, such as an argon gas, in general, however, the interfaces of built-up portion are still oxidized by slight air mixing so that they might cause welding failures. Moreover, because of solid oxide films generated on the surfaces, the flowability deteriorates to result in welding failures and mismatched beads, and there might be a case that they hinder the building-up ability.

Further, in order to cope with much severer service conditions, and in order to improve the wear resistance, when turning the alloys into a high-Mo composition and increasing the Ni content in order to relax the hard particles' coarsening resulting therefrom, there might be a case that the crack resistance during building up deteriorates so that bead cracks occur.

The present invention has been done in view of the aforementioned circumstances, and provides a build-up wear-resistant copper alloy and valve seat, which have good wear resistance while furthermore securing the building-up ability and crack resistance.

A build-up wear-resistant copper alloy according to a first invention is characterized by having a composition of nickel: 5.0-24.5%, iron: 3.0-20.0%, silicon: 0.5-5.0%, boron: 0.05-0.5%, chromium: 0.3-5.0%, one member or two members or more selected from the group consisting of molybdenum, tungsten and vanadium: 3.0-20.0%, by weight %, and the balance being copper and inevitable impurities.

A build-up wear-resistant copper alloy according to a second invention is characterized by having a composition of nickel: 3.0-22.0%, iron: 2.0-15.0%, silicon: 0.5-5.0%, boron: 0.05-0.5%, and chromium: 0.3-5.0%, as well as one member or two members or more selected from the group consisting of molybdenum, tungsten, vanadium and niobium: 2.0-15.0%, and cobalt: 2.0-15.0%, by weight %, and the balance being copper and inevitable impurities.

In accordance with the build-up wear-resistant copper alloys according to the first and second inventions, the borides of chromium distribute very finely in the hard particles by containing chromium, which is more likely to make borides than nickel and iron are, with boron compositely, and accordingly it is possible to avoid the adverse effects which arise from the independent addition of boron.

That is, when boron and chromium are not contained in proper amounts compositely, the surfaces of the hard particles (the interfaces to the matrix) have large irregularities and are complicated intricately. This state hinders the ductility of the matrix, and becomes the cause of the generation of cracks during building up.

On the other hand, like the build-up wear-resistant copper alloys according to the present invention, when containing boron and chromium in proper amounts simultaneously, the interfaces between the hard particles and the matrix become smooth so that the crack resistance of the matrix is improved, as set forth in later-described examples.

In the present description, % means weight %, unless otherwise stated. The copper alloys of the present invention are alloys in which the weight % of copper, the balance obtained by subtracting the total amount of the additive elements from 100 weight %, surpasses the independent weight % of the respective additive elements.

EFFECT OF THE INVENTION

In accordance with the present invention, a build-up wear-resistant copper alloy and a valve seat for internal combustion engines are secured by compositely containing boron and chromium in proper amounts, build-up wear-resistant copper alloy and valve seat whose building-up abilities, such as weldability and crack resistance during building up, are improved and which have good wear resistance at the same time.

Figure 1:
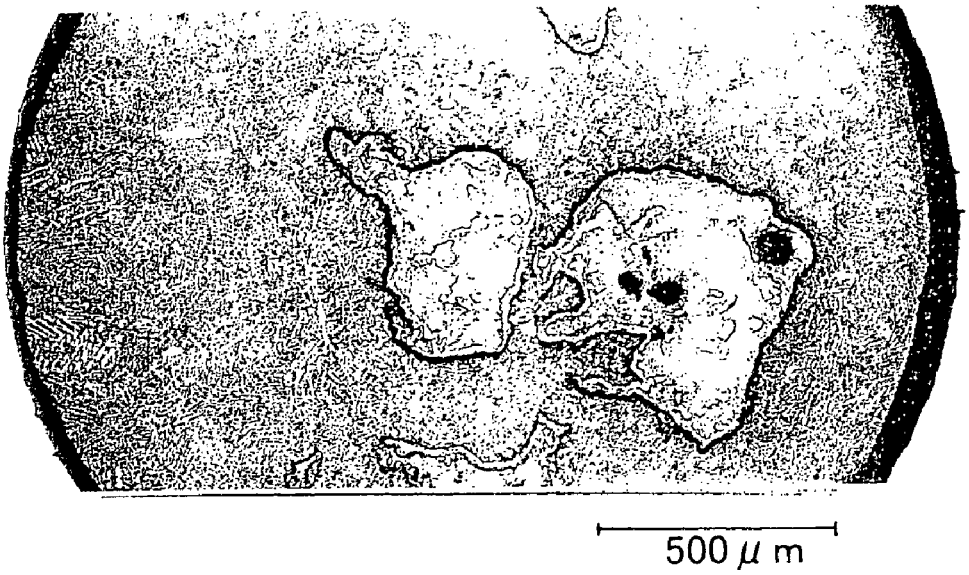
FIG. 1 is a copy of a microscope photograph of an alloy according to Comparative Example No. 1.

BEST MODE FOR CARRYING OUT THE INVENTION (1) In alloys containing boron, when they contact with the air in melted state, they generate boric oxide ($B_2O_3$). This $B_2O_3$ acts as a flux so that build-up wear-resistant copper alloys' flowability and weldability to substrate are improved.

The metallic structure of the build-up wear-resistant alloy according to the present invention is such that the hard particles are distributed in the soft matrix. If only boron is added to copper alloys, the borides of nickel, iron and molybdenum, which are coarse, very hard and brittle, are generated within the hard particles, or within the matrices. As a result, the hard particles become likely to crack, and result in the degradation of crack resistance during building up. Moreover, by these coarse and very hard borides, mating members are worn roughly, though the worn amount of the copper alloys themselves is small, and accordingly the so-called aggressiveness to mating member has heightened. On the contrary, by adding chromium, which is more likely to make borides than nickel and iron are, together with a proper amount of boron compositely, the borides of chromium, or borides which include chromium along with at least one member selected from the group consisting of molybdenum, tungsten and vanadium, and hard phases in which chromium and boron have joined the conventional hard-phase (silicide) components are distributed very finely in the inside of the hard particles, and consequently it is believed possible to avoid the aforementioned adverse effects, which arise from the independent addition of boron.

When boron and chromium are not added compositely, the surfaces of the hard particles (the interfaces between the hard particles and the matrix) have large irregularities and are complicated intricately, as described above. Moreover, in the matrix, squared compounds (Fe—Mo and Co—Mo) are distributed, in addition to nickel silicide. These sates hinder the ductility of the matrix, and become causes of the occurrence of cracks during building up. In alloys in which proper amounts of boron and chromium are contained compositely, the interfaces between the hard particles and the matrix become smooth so that the crack resistance of the matrix is improved, as set forth in later-described examples.

(2) Explanations on the reasons for limiting the composition according to the build-up wear-resistant copper alloy according to the present invention will be added.

Nickel

Nickel solves in copper partially to enhance the toughness of the copper-based matrix, and the other part thereof forms hard silicides (silicide) in which nickel is a major component to enhance the wear resistance by dispersion strengthening. Moreover, it can be expected that nickel forms the hard phases of the hard particles along with cobalt, iron, and the like. Being less than the aforementioned lower limit value of the content, the characteristics possessed by copper-nickel-based alloys, especially, the favorable corrosion resistance, heat resistance and wear resistance become less likely to be demonstrated, further, the hard particles decrease so that the aforementioned effects cannot be obtained sufficiently. Furthermore, the feasible contents for adding cobalt and iron become less. Surpassing the aforementioned upper limit value of the content, the hard particles become excessive so that the toughness lowers and cracks become likely to occur when being turned into build-up layers, further, the building-up ability with respect to physical objects being mating members for building up degrades.

Taking the aforementioned circumstances into consideration, nickel is adapted to 5.0-24.5% in the first invention. In this instance, taking the aforementioned circumstances into consideration, it can be adapted to 5.0-22.0%, or 5.2-20.0%, further, 5.4-19.0%, or 5.6-18.0%. Note that, depending on the significant degrees of the various qualities requested for the build-up wear-resistant copper alloy according to the present invention, as for the aforementioned lower limit value of the content range of nickel, it is possible to exemplify 5.2%, 5.5%, 6.0%, 6.5%, or 7.0%, and, as for the upper limit value corresponding to the lower limit value, it is possible to exemplify 24.0%, 23.0%, or 22.0%, for example, further, 20.0%, 19.0%, or 18.0%, however, it is not limited to these.

Taking the aforementioned circumstances into consideration, nickel is adapted to 3.0-22.0% in the second invention with cobalt increased. In this instance, taking the aforementioned circumstances into consideration, it can be adapted to 4.0-20.0%, or 5.0-19.0%. Note that, depending on the significant degrees of the various qualities requested for the build-up wear-resistant copper alloy according to the present invention, as for the aforementioned lower limit value of the content range of nickel, it is possible to exemplify 4.2%, 5.5%, 6.0%, 6.5%, or 7.0%, and, as for the upper limit value corresponding to the lower limit value, it is possible to exemplify 21.0%, 20.6%, 20.0%, 19.0%, or 18.0%, for example, however, it is not limited to these.

Silicon

Silicon is an element which forms silicides (silicide), and forms silicides in which nickel is a major component, further, it contributes to strengthening the copper-based matrix. Being less than the aforementioned lower limit value of the content, the aforementioned effects cannot be obtained sufficiently. Surpassing the aforementioned upper limit value of the content, the toughness of the build-up wear-resistant copper alloy degrades, cracks become likely to occur when being turned into build-up layers, and the building-up ability with respect to physical objects degrades. Taking the aforementioned circumstances into consideration, silicon is adapted to 0.5-5.0%. For example, silicon can be adapted to 1.0-4.0%, especially, 1.5-3.0%. Depending on the significant degrees of the various qualities requested for the build-up wear-resistant copper alloy according to the present invention, as for the aforementioned lower limit value of the content range of silicon, it is possible to exemplify 0.55%, 0.6%, 0.65%, or 0.7%, and, as for the upper limit value corresponding to the lower limit value, it is possible to exemplify 4.5%, 4.0%, 3.8%, or 3.0%, however, it is not limited to these.

Iron

Iron acts similarly to cobalt fundamentally, and can substitute for high-cost cobalt. Iron hardly solves in the copper-based matrix, and is likely to be present mainly as silicides in the hard particles. In order to generate the aforementioned silicides abundantly, iron is adapted to 3.0-20.0% in the first invention, and iron is adapted to 2.0-15.0% in the second invention. Being less than the aforementioned lower limit value of the content, the hard particles decrease to degrade the wear-resistance so that the aforementioned effects cannot be obtained sufficiently. Surpassing the aforementioned upper limit of the content, the hard phases in the hard particles become coarse, and the crack resistance of the build-up wear resistant copper alloy degrades, further, the opponent aggressiveness heightens.

Taking the aforementioned circumstances into consideration, iron can be adapted to 3.2-19.0%, especially, 3.4-18.0%, in the first invention. Depending on the significant degrees of the various qualities requested for the build-up wear-resistant copper alloy according to the first invention, as for the aforementioned upper limit value of the content range of iron, it is possible to exemplify 19.0%, 18.0%, 17.0%, or 16.0%, and, as for the lower limit value corresponding to the upper limit value, it is possible to exemplify 3.2%, 3.4%, or 3.6%, however, it is not limited to these. Taking the aforementioned circumstances into consideration, iron can be adapted to 2.2-14.0%, especially, 3.4-12.0%, in the second invention. Depending on the significant degrees of the various qualities requested for the build-up wear-resistant copper alloy according to the second invention, as for the aforementioned upper limit value of the content range of iron, it is possible to exemplify 14.0%, 13.0%, 12.0%, or 11.0%, and, as for the lower limit value corresponding to the upper limit value, it is possible to exemplify 2.2%, 2.4%, or 2.6%, however, it is not limited to these.

Chromium

Chromium is contained in the matrix, and is alloyed with a part of nickel and a part of cobalt to enhance the oxidation resistance. Further, chromium is present in the hard particles as well, and enhances the liquid-phase separation tendency in molten liquid states. Moreover, chromium is likely to make boride, and, by adding it along with boron compositely, the boride of chromium, or boride including chromium and simultaneously including at least one member selected from the group consisting of molybdenum, tungsten and vanadium, and hard phases in which chromium and boron are added to the conventional hard-phase (silicide) components are distributed finely in the inside of the hard particles, and accordingly it is possible to avoid the aforementioned adverse effects which arise from the independent addition of boron. Being less than the aforementioned lower limit value of the content, the aforementioned effects cannot be obtained sufficiently. Surpassing the aforementioned upper limit of the content, the hard phases in the hard particles become coarse, and the opponent aggressiveness heightens. Taking the aforementioned circumstances into consideration, chromium is adapted to 0.3-5.0%. For example, chromium can be adapted to 0.35-4.8%, or 0.4-4.0%, especially, 0.6-3.0%, or 0.8-1.8%. Depending on the significant degrees of the various qualities requested for the build-up wear-resistant copper alloy according to the present invention, as for the aforementioned lower limit value of the content range of chromium, it is possible to exemplify 0.4%, 0.5%, or 0.8%, and, as for the upper limit value corresponding to the lower limit value, it is possible to exemplify 4.8%, 4.0%, or 3.0%, for example, however, it is not limited to these.

As aforementioned, since chromium is contained in both of the matrix and hard particles, the chromium content can preferably be higher than the boron content. Therefore, the chromium content can be contained 4 times or more of the boron content. Especially, the chromium content can be contained 5 times or more, 6 times or more, or 8 times or more of the boron content, further, 10 times or more. As for the upper limit, the chromium content can be adapted to 20 times or less, 50 times or less, or 100 times or less of the boron content, though it depends on the boron content.

One Member or Two Members or More Selected from the Group Consisting of Molybdenum, Tungsten and Vanadium Molybdenum, tungsten and vanadium combine with silicon to generate silicides (in general, silicide having toughness) within the hard particles to enhance the wear resistance and lubricating property at high temperatures. These silicides are such that the hardness is lower than Co—Mo-based silicide and the toughness is high. Accordingly, they generate within the hard particles to enhance the wear resistance and lubricating property at high temperatures. Silicides in which one member or two members or more selected from the group consisting of the aforementioned molybdenum, tungsten and vanadium are major components are likely to generate oxide, which is full of solid lubricating property, even in a relatively low temperature range of 500-700° C. approximately, and additionally even in low oxygen-pressure environments. This oxide covers the surfaces of the copper-based matrix in service to become advantageous in avoiding the direct contact between a mating member and the matrix. Thus, the self-lubricating property can be secured.

When one member or two members or more selected from the group consisting of molybdenum, tungsten and vanadium are less than the aforementioned lower limit value of the content, the wear resistance degrades, and the improvement effects cannot be demonstrated sufficiently. Moreover, surpassing the upper limit value, the hard particles become excessive, the toughness is impaired, the crack resistance degrades, and cracks become likely to occur. Taking the aforementioned circumstances into consideration, it is adapted to 3.0-20.0% in the alloy according to the first invention. Depending on the significant degrees of the various qualities requested for the build-up wear-resistant copper alloy, as for the aforementioned lower limit value of the content range of one member or two members or more selected from the group consisting of molybdenum, tungsten and vanadium, it is possible to exemplify 3.2%, 3.6%, or 4.0%, and, as for the upper limit value corresponding to the lower limit value, it is possible to exemplify 18.0%, 17.0%, or 16.0%, however, it is not limited to these.

Taking the aforementioned circumstances into consideration, it is adapted to 2.0-15.0% in the alloy (including cobalt) according to the second invention. Depending on the significant degrees of the various qualities requested for the build-up wear-resistant copper alloy, as for the aforementioned lower limit value of the content range of one member or two members or more selected from the group consisting of molybdenum, tungsten and vanadium, it is possible to exemplify 3.0%, 4.0%, or 5.0%, and, as for the upper limit value corresponding to the lower limit value, it is possible to exemplify 14.0%, 13.0%, or 12.0%, however, it is not limited to these.

Boron

When alloys containing boron contact with the air in melted state, they generate boric oxide ($B_2O_3$). This $B_2O_3$ acts as a flux so that build-up wear-resistant copper alloys' flowability and weldability to substrate are improved.

When boron and chromium are not added compositely, the surfaces of the hard particles (the interfaces between the hard particles and the matrix) have large irregularities and are complicated intricately, as described above. These sates hinder the ductility of the matrix, and become the starting points of the occurrence of cracks during building up. In alloys in which proper amounts of boron and chromium are contained compositely, the interfaces between the hard particles and the matrix become smooth so that the crack resistance of the matrix is improved, as set forth in later-described examples. Considering this, or, depending on the chromium content, boron is adapted to 0.05-0.5%. Depending on the significant degrees of the various qualities, as for the lower limit value of boron, it is possible to exemplify 0.08%, 0.1%, or 0.12%, and, as for the upper limit value corresponding to the lower limit value, it is possible to exemplify 0.45%, 0.4%, or 0.3%, however, it is not limited to these.

Cobalt

Cobalt cannot necessarily be contained in the alloy according to the first invention, and can be held in an amount of 0.01-2.00%. Cobalt hardly dissolves in the inside of copper, and acts to stabilize silicide.

Moreover, cobalt forms solid solutions with nickel, iron, chromium, and the like, and a tendency of improving the toughness is appreciable. Moreover, cobalt enhances the liquid-phase separation tendency in molten liquid states. It is believed that liquid phases, which are separated from liquid-phase portions becoming the matrix, generate the hard particles mainly. Being less than the aforementioned lower limit value of the content, a fear that the aforementioned effects cannot be obtained sufficiently is highly likely. Taking the aforementioned circumstances into consideration, in accordance with the alloy according to the first invention, cobalt can be contained in an amount of 0.01-2.00%. For example, cobalt can be contained in an amount of 0.01-1.97%, 0.01-1.94%, or 0.20-1.90%, especially, 0.40-1.85%. Depending on the significant degrees of the various qualities requested for the build-up wear-resistant copper alloy according to the present invention, as for the aforementioned upper limit value of the content range of cobalt, it is possible to exemplify 1.90%, 1.80%, 1.60%, or 1.50%, and, as for the lower limit value corresponding to the upper limit value, it is possible to exemplify 0.02%, 0.03%, or 0.05%, however, it is not limited to these.

Taking the aforementioned circumstances into consideration, in accordance with the alloy according to the second invention, cobalt is adapted to 2.0-15.0%. For example, cobalt can be adapted to 3.0-14.0%, 4.0-13.0%, or 5.0-12.0%. Depending on the significant degrees of the various qualities requested for the build-up wear-resistant copper alloy according to the present invention, as for the aforementioned lower limit value of the content range of cobalt, it is possible to exemplify 2.5%, 3.5%, 4.5%, 5.5%, or 6.5%, and, as for the upper limit value corresponding to the lower limit value, it is possible to exemplify 14.0%, 13.0%, or 12.0%, however, it is not limited to these.

The metallic structure of the build-up wear-resistant alloy according to the present invention is such that the hard particles, which are harder than the matrix, are distributed in the matrix. If only boron is added to alloys, the borides of nickel, iron and molybdenum, which are coarse, very hard and brittle, are generated within the hard particles, or within the matrices. As a result, the hard particles become likely to crack, and result in the degradation of crack resistance during building up. Moreover, by these coarse and very hard borides, mating members are worn roughly, though the worn amount of the copper alloys themselves is small, and accordingly the so-called aggressiveness to mating member has heightened. On the contrary, by adding chromium, which is more likely to make borides than nickel and iron are, together with boron compositely, the borides of chromium, or borides which include chromium along with at least one member selected from the group consisting of molybdenum, tungsten and vanadium, and hard phases in which chromium and boron have joined the conventional hard-phase (silicide) components are distributed very finely in the hard particles, and consequently the aforementioned adverse effects, which arise from the independent addition of boron, can be avoided.

Regarding hard particles in which boron and chromium are not added compositely, the surfaces of the hard particles (the interfaces between the hard particles and the matrix) are complicated intricately. In alloys with boron and chromium added compositely, the interfaces between the hard particles and the matrix become smooth so that the crack resistance of the matrix is improved.

(3) The build-up wear-resistant copper alloy according to the present invention can employ at least one of the following embodiment modes.

The build-up wear-resistant copper alloy according to the present invention can be used as build-up alloys which are built up onto physical objects, for example. As a build-up method, it is possible to exemplify methods for building up by welding, using a high-density energy thermal source, such as laser beams, electron beams and arcs. In the case of building up, the build-up wear resistant copper alloy according to the present invention is turned into a powder or a bulky body to make a raw material for building up, and can be built up by welding, using a thermal source which is represented by the aforementioned high-density energy thermal source, such as laser beams, electron beams and arcs, with the powder or bulky body being assembled onto a portion to be built up. Moreover, the aforementioned build-up wear-resistant copper alloy can be turned into a wired or rod-shaped raw workpiece for building up, not being limited to the powder or bulky body. As for the laser beams, it is possible to exemplify those which have high energy densities, such as carbon dioxide laser beams and YAG laser beams. As for the material qualities of the physical objects to be built up, it is possible to exemplify aluminum, aluminum-based alloys, iron or iron-based alloys, copper or copper-based alloys, and the like, however, they are not limited to these. As for the fundamental compositions of aluminum alloys constituting the physical objects, it is possible to exemplify aluminum alloys for casting, such as Al—Si systems, Al—Cu systems, Al—Mg systems, Al—Zn Systems, for instance. As for the physical objects, it is possible to exemplify engines, such as internal combustion engines and external combustion engines, however, they are not limited to these. In the case of the internal combustion engines, it is possible to exemplify valve-system materials. In this instance, it can be applied to valve seats constituting exhaust ports, or can be applied to valve seats constituting intake ports. In this instance, the valve seats themselves can be constituted of the build-up wear-resistant alloy according to the present invention, or the build-up wear-resistant alloy according to the present invention can be built up onto the valve seats. However, the build-up wear-resistant alloy according to the present invention is not limited to the valve-system materials for engines, such as internal combustion engines, but can be used as well for the other systems' sliding materials, sliding members and sintered materials, for which wear resistance is requested.

(4) As for the build-up wear-resistant copper alloy according to the present invention, it can constitute built-up layers after building up, or it can be alloys for building up prior to building up. The build-up wear-resistant copper alloy according to the present invention can be applied to copper-based sliding members and sliding parts, for example, and can be applied to copper-based valve-system materials, which are loaded onto internal combustion engines, specifically.

Examples

Hereinafter, examples of the present invention will be described along with comparative examples. Starting materials, which were compounded so as to make the target compositions of examples and comparative examples, were melted with a furnace at 1,600° C. in an argon gas atmosphere. And, using a 6-mm-outside-diameter and 2-mm-thickness pipe made of stainless (material quality SUS316), the 1,600-° C. molten metals were cast by suction, and were solidified to form test pieces. Table 1 sets forth the compositions of alloys according to examples and comparative examples. The alloys of Example Nos. 1-4 contain both B and Cr in proper amounts compositely. The alloys of Comparative Example Nos. 1-5 do not contain both B and Cr compositely. Comparative Example Nos. 1-3 contain B, but do not contain Cr. Regarding the evaluation in Table 1, those whose irregularities of hard particles' surfaces are large are labeled ○, and those whose irregularities of hard particles' surfaces are small are labeled ◎.

TABLE 1

| | Alloy Composition Weight % | | | | | | | | |
|---|---|---|---|---|---|---|---|---|---|
| | Ni | Fe | Si | Mo | B | Cr | Co | Cu | Evaluation |
| Comp. Ex. No. 1 | 16.5 | 9 | 2.3 | 8.5 | 1 | — | — | Balance | ○ |
| Comp. Ex. No. 2 | 16.5 | 9 | 2.3 | 8.5 | 0.5 | — | — | Balance | ○ |
| Comp. Ex. No. 3 | 20.5 | 9 | 2.3 | 8.5 | 0.25 | — | — | Balance | ○ |
| Comp. Ex. No. 4 | 20.5 | 9 | 2.3 | 8.5 | — | — | — | Balance | ○ |
| Comp. Ex. No. 5 | 16 | 5 | 2.9 | 6.2 | — | 1.5 | 7.3 | Balance | ○ |
| Ex. No. 1 | 20.5 | 9 | 2.3 | 8.5 | 0.125 | 1.5 | — | Balance | ◎ |
| Ex. No. 2 | 20.5 | 9 | 2.3 | 8.5 | 0.25 | 1.5 | — | Balance | ◎ |
| Ex. No. 3 | 20.5 | 9 | 2.3 | 8.5 | 0.25 | 3.0 | — | Balance | ◎ |
| Ex. No. 4 | 22 | 5 | 2.9 | 9.3 | 0.25 | 1.5 | 7.3 | Balance | ◎ |

Optical-microscopic structures of the respective alloys constituting the test pieces will be described.

The present alloy is, basically, such that the relatively coarse-particulate hard particles, the fine-particulate Fe—Mo or Co—Mo compound, and nickel silicide are dispersed within the relatively soft Cu—Ni—Si-based matrix (containing Fe or Co). The wear resistance of the present alloy is secured mainly by the hard particles. The hard particles, basically, become the constitution that the hard-phase fine particles comprising Fe—(Co)—Ni—Mo—Si are dispersed within the relatively soft Ni—Fe—(Co)—Si-based solid solution. (Co) means that Co is not essential.

FIG. 1 illustrates the metallic structure of Comparative Example No. 1. Comparative Example No. 1 is an alloy having a Cu-16.5% Ni-9% Fe-2.3% Si-8.5% Mo-1% B composition, and does not contain Cr. As shown in FIG. 1, in the alloy according to Comparative Example No. 1 which contains 1% B but does not contain Cr, the hard particles are very coarse and additionally are strangely-shaped considerably so that it is not practical.

Figure 2:
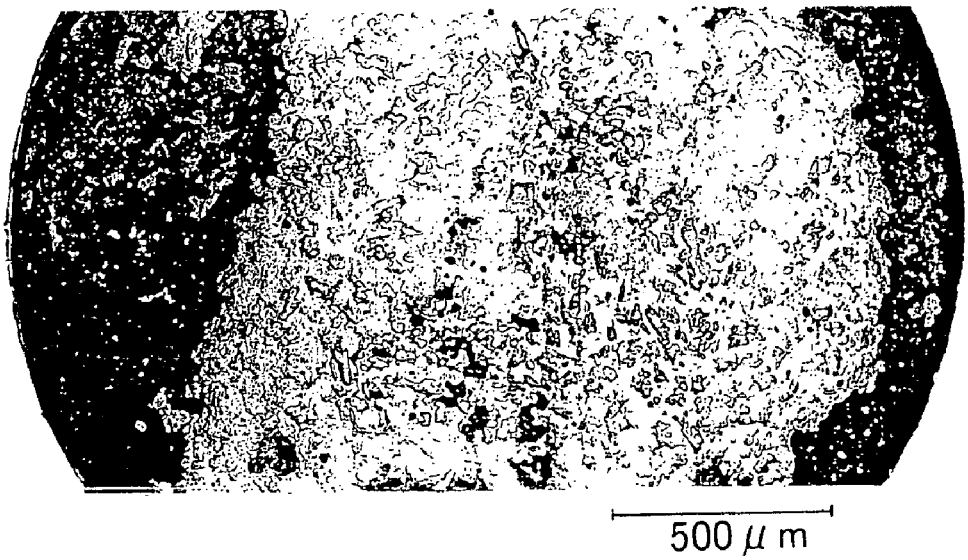
FIG. 2 is a copy of a microscope photograph of an alloy according to Comparative Example No. 2.
Figure 3:
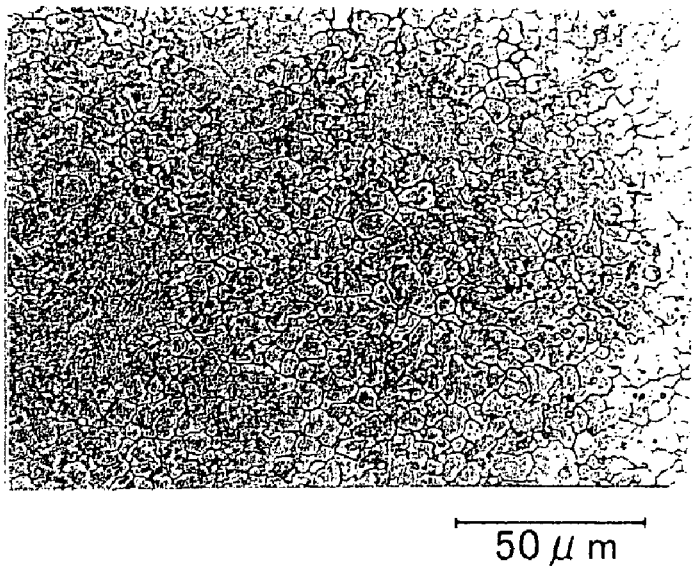
FIG. 3 is a copy (enlarged) of a microscope photograph of the alloy according to Comparative Example No. 2.

FIG. 2 and FIG. 3 illustrate the metallic structure of Comparative Example No. 2. Comparative Example No. 2 is an alloy having a Cu-16.5% Ni-9% Fe-2.3% Si-8.5% Mo-0.5% B composition, and does not contain Cr. As shown in FIG. 2 and FIG. 3, in the alloy according to Comparative Example No. 2 which contains 0.5% B but does not contain Cr, the hard particles are very coarse and additionally are strangely-shaped considerably so that it is not practical.

Figure 4:
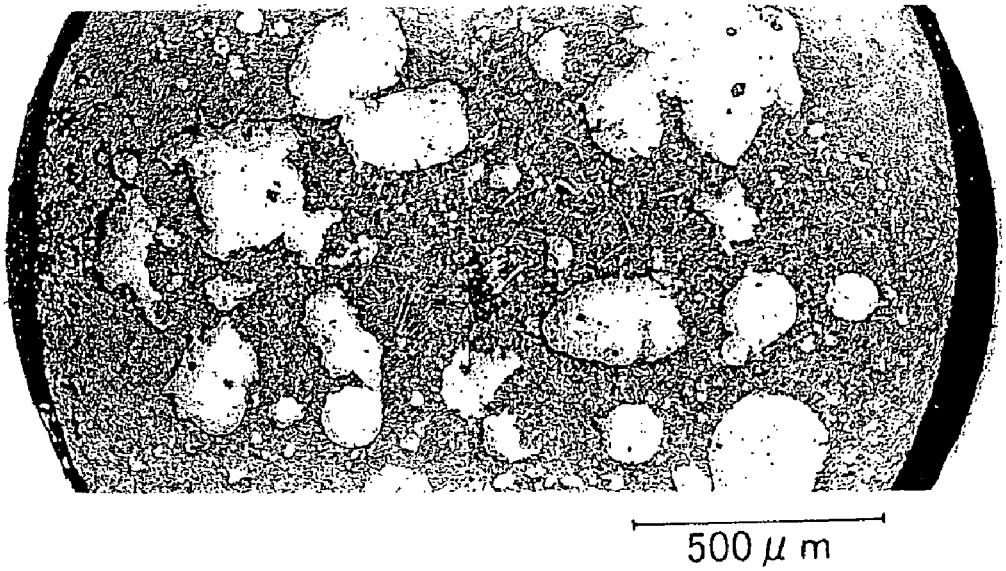
FIG. 4 is a copy of a microscope photograph of an alloy according to Comparative Example No. 3.
Figure 5:
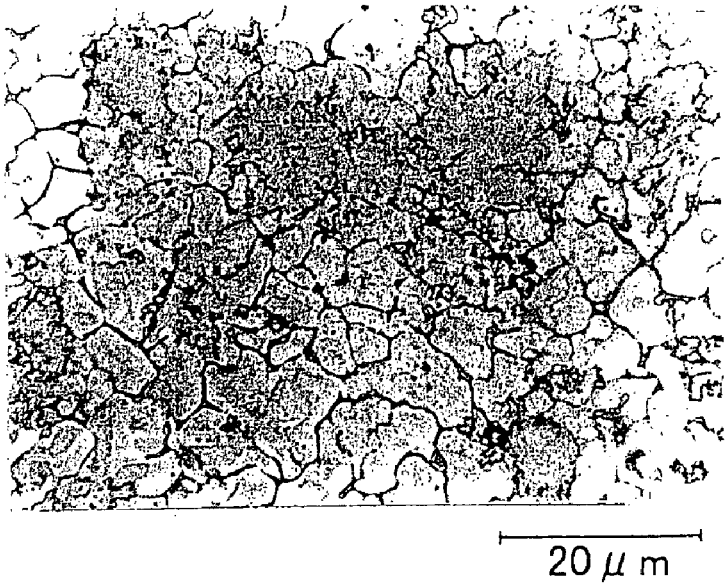
FIG. 5 is a copy (enlarged) of a microscope photograph of the alloy according to Comparative Example No. 3.

FIG. 4 and FIG. 5 illustrate the metallic structure of Comparative Example No. 3. Comparative Example No. 3 is an alloy in which the B addition amount is as furthermore less as 0.25%, is an alloy having a Cu-20.5% Ni-9% Fe-2.3% Si-8.5% Mo-0.25% B composition, but does not contain Cr. When the B content is reduced to 0.25% like this, as shown in FIG. 4 and FIG. 5, the hard particles become fine, but remarkable irregularities are appreciated in the surfaces of the particles (the interfaces to the matrix).

Figure 6:
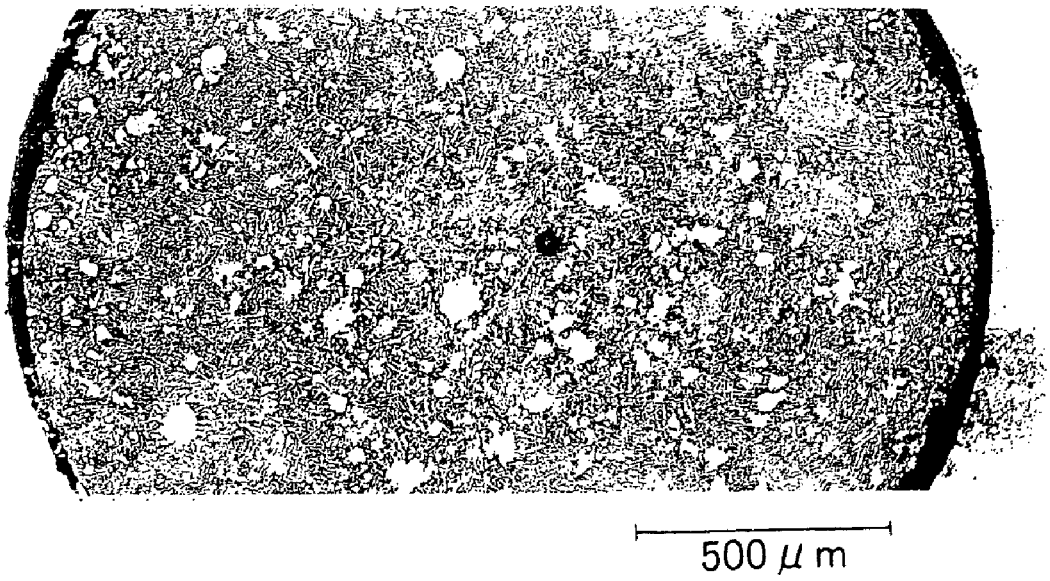
FIG. 6 is a copy of a microscope photograph of an alloy according to Comparative Example No. 4.
Figure 7:
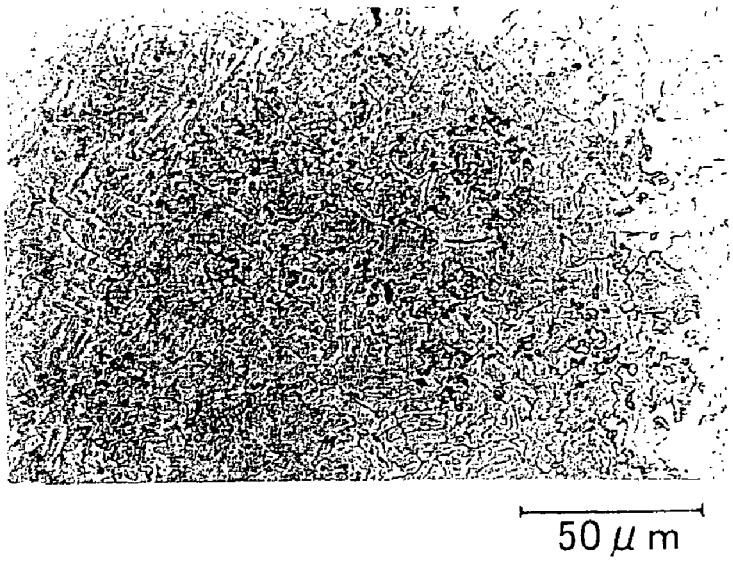
FIG. 7 is a copy (enlarged) of a microscope photograph of the alloy according to Comparative Example No. 4.

FIG. 6 and FIG. 7 illustrate the metallic structure of Comparative Example No. 4. Comparative Example No. 4 is an alloy in which both B and Cr are not contained, is an alloy having a Cu-20.5% Ni-9% Fe-2.3% Si-8.5% Mo composition, and does not contain B and Cr. As shown in FIG. 6 and FIG. 7, remarkable irregularities are appreciated in the surfaces of the hard particles, particularly, the minor-particle-diameter hard particles.

Figure 8:
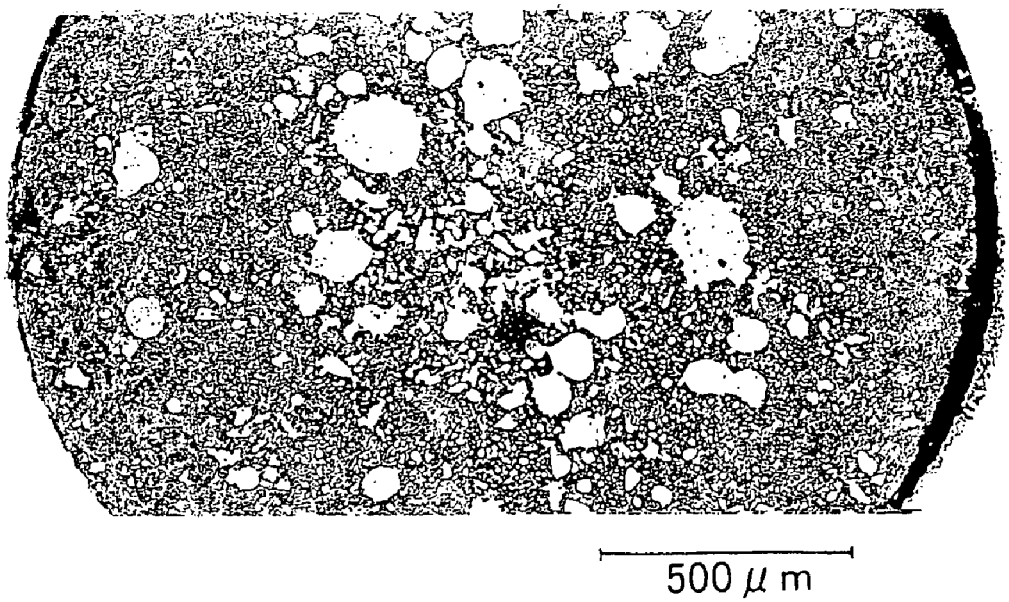
FIG. 8 is a copy of a microscope photograph of an alloy according to Example No. 1.
Figure 9:
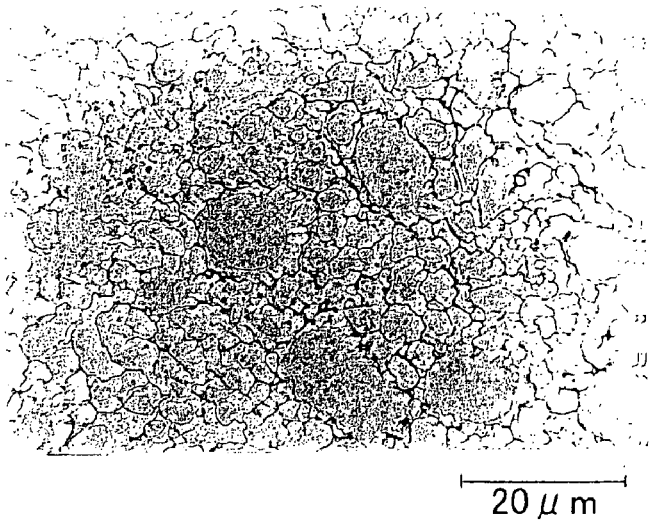
FIG. 9 is a copy (enlarged) of a microscope photograph of the alloy according to Example No. 1.

FIG. 8 and FIG. 9 illustrate the metallic structure of the alloy of Example No. 1 equivalent to the first invention. This alloy has a Cu-20.5% Ni-9% Fe-2.3% Si-8.5% Mo-0.125% B-1.5% Cr composition. When the Cr content/B content is taken as an $\alpha$ value, it is $\alpha$=1.5%/0.125%=12. As shown in FIG. 8 and FIG. 9, by containing B and Cr in proper amounts compositely, it is seen that the irregularities formed in the surfaces of the hard particles become small considerably so that the surfaces of the hard particles become smooth. As shown in FIG. 8 and FIG. 9, the hard particles' shapes themselves are made into shapes close to circles (spheres) by containing B and Cr in proper amounts compositely.

Figure 10:
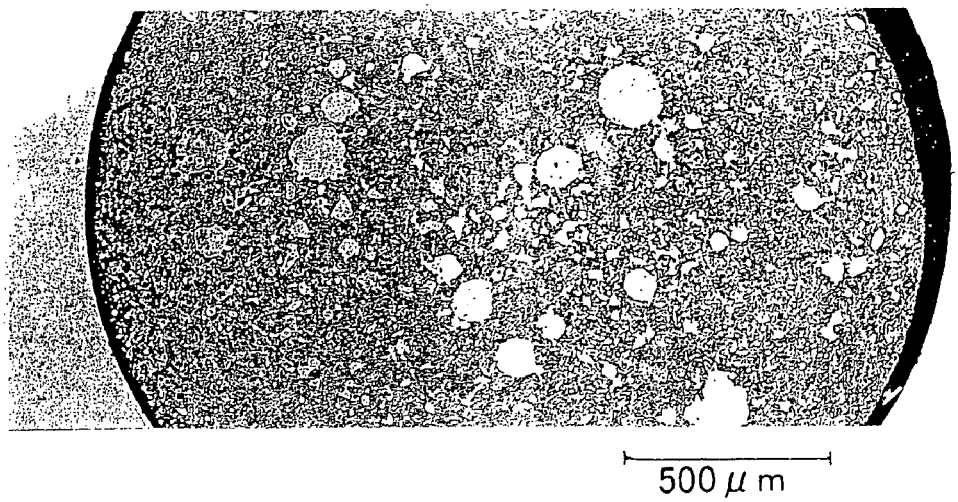
FIG. 10 is a copy of a microscope photograph of an alloy according to Example No. 2.
Figure 11:
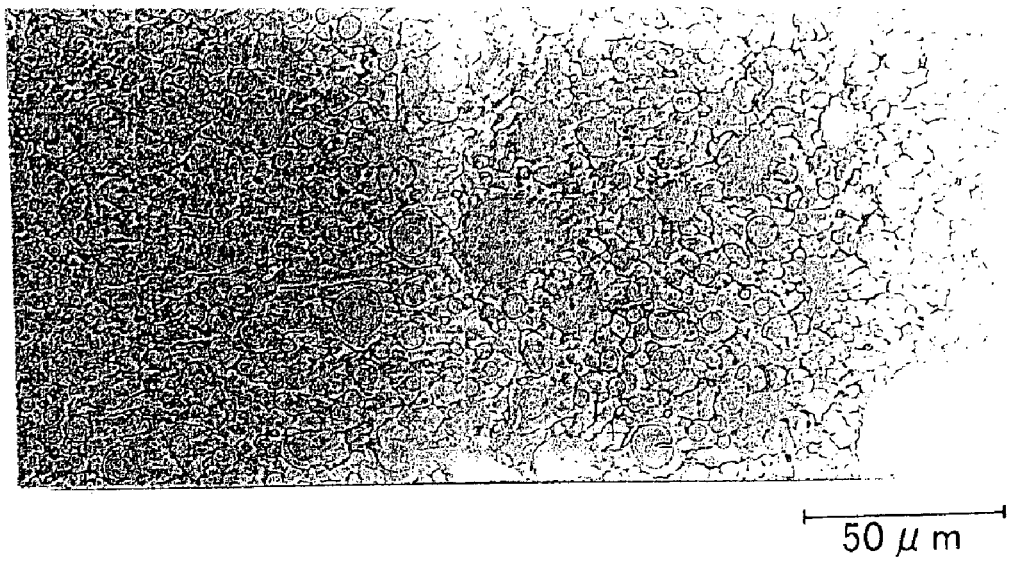
FIG. 11 is a copy (enlarged) of a microscope photograph of the alloy according to Example No. 2.
Figure 12:
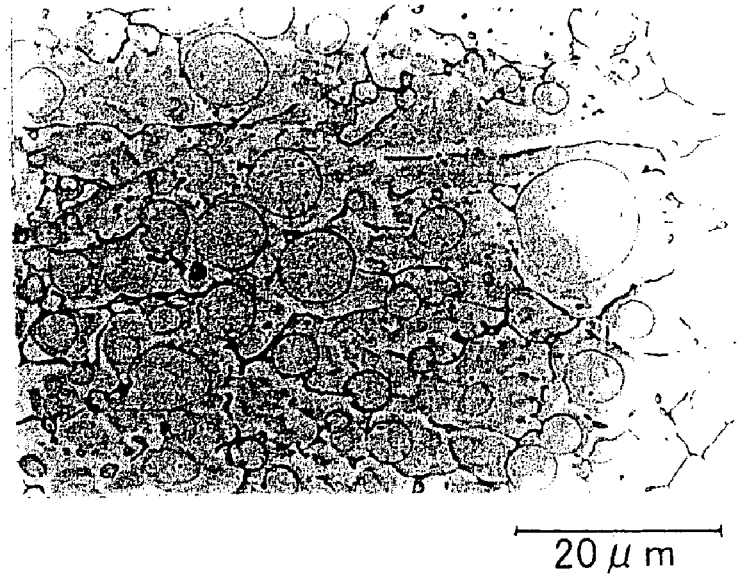
FIG. 12 is a copy (enlarged) of a microscope photograph of the alloy according to Example No. 2.

FIG. 10 through FIG. 12 illustrate the metallic structure of the alloy of Example No. 2 equivalent to the first invention. This alloy has a Cu-20.5% Ni-9% Fe-2.3% Si-8.5% Mo-0.25% B-1.5% Cr composition. When the Cr content/B content is taken as an $\alpha$ value, it is $\alpha$=1.5%/0.25%=6. As shown in FIG. 10 through FIG. 12, in the present alloy in which the B content is more than the aforementioned alloy, it is seen that the surfaces of the hard particles become further smooth, and that the hard particles, which are close to circular shapes (spherical shapes), are formed.

Figure 13:
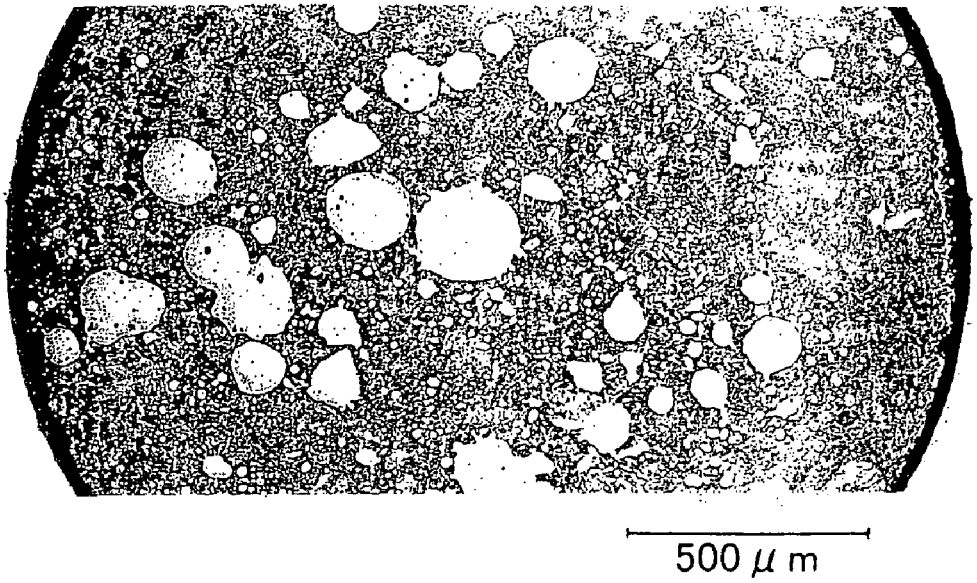
FIG. 13 is a copy of a microscope photograph of an alloy according to Example No. 3.
Figure 14:
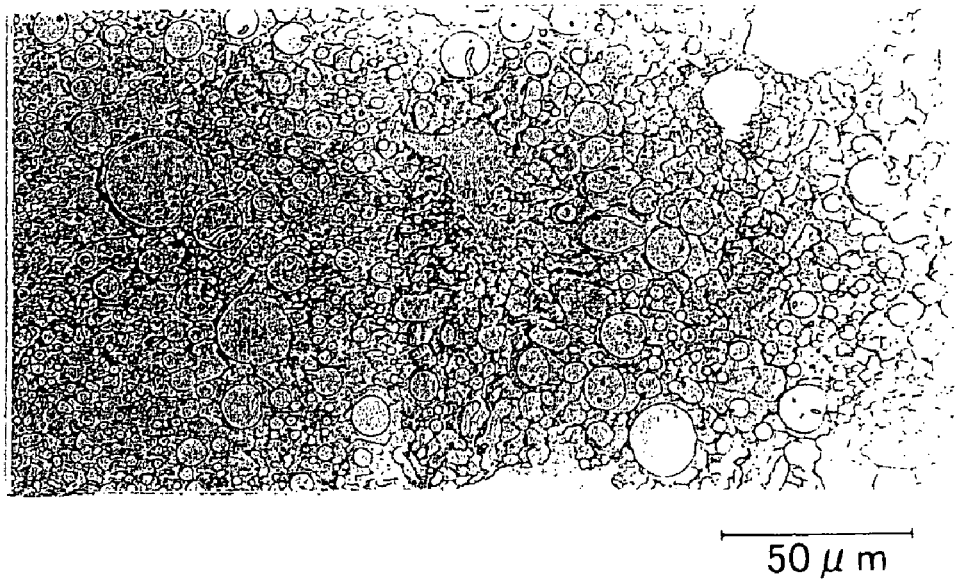
FIG. 14 is a copy (enlarged) of a microscope photograph of the alloy according to Example No. 3.
Figure 15:
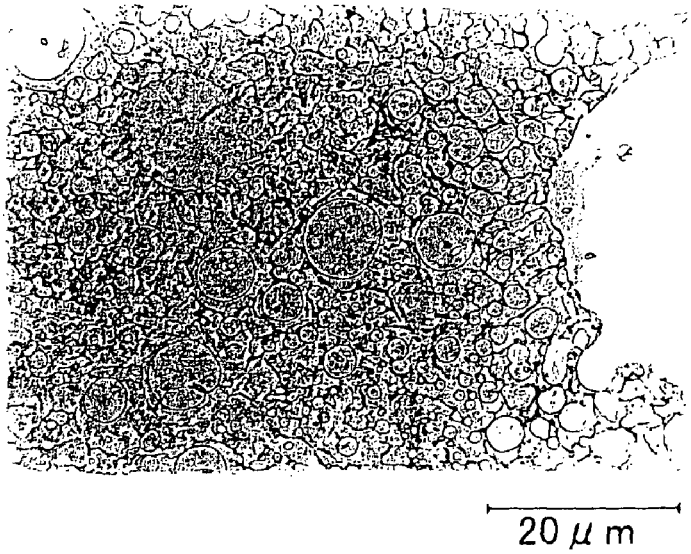
FIG. 15 is a copy (enlarged) of a microscope photograph of the alloy according to Example No. 3.

FIG. 13 through FIG. 15 illustrate the metallic structure of the alloy of Example No. 3 equivalent to the first invention. This alloy has a Cu-20.5% Ni-9% Fe-2.3% Si-8.5% Mo-0.25% B-3% Cr composition. When the Cr content/B content is taken as an $\alpha$ value, it is $\alpha$=3%/0.25%=12. As shown in FIG. 13 through FIG. 15, in the present alloy in which the Cr content is more than the aforementioned alloys while containing B and Cr compositely, it is seen that the surfaces of the hard particles become furthermore smooth, and that the hard particles, which are close to circular shapes (spherical shapes), are formed.

Figure 16:
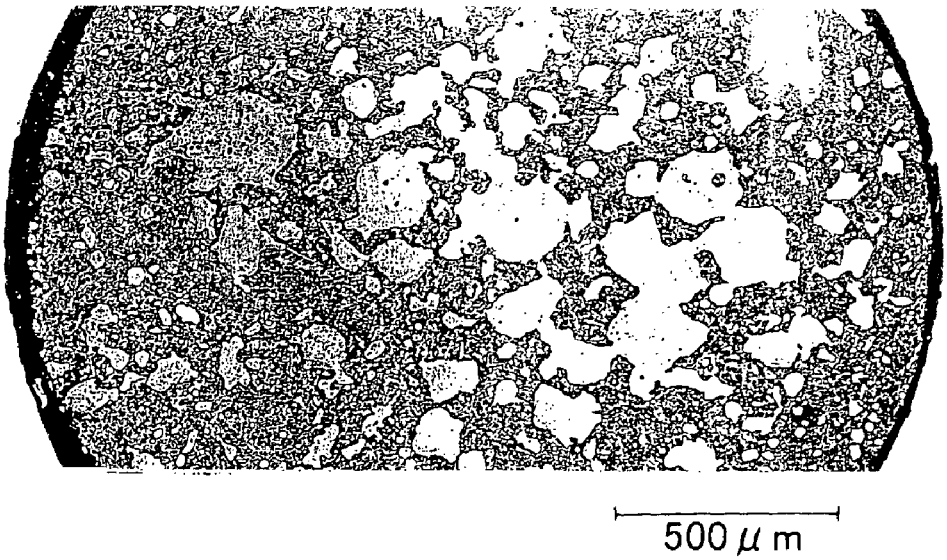
FIG. 16 is a copy of a microscope photograph of an alloy according to Example No. 4.
Figure 17:
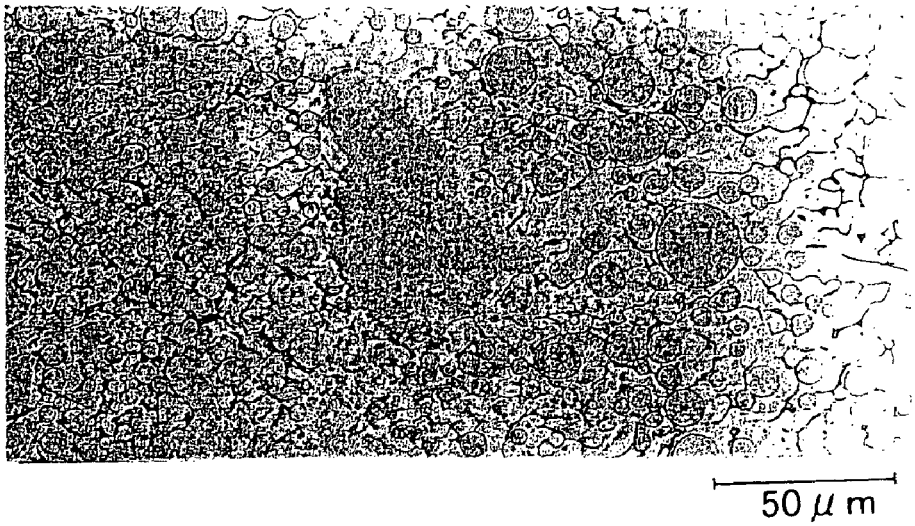
FIG. 17 is a copy (enlarged) of a microscope photograph of the alloy according to Example No. 4.
Figure 18:
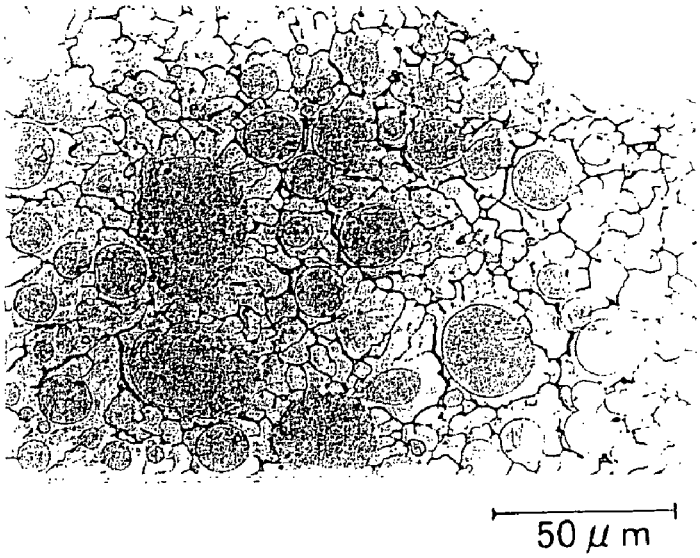
FIG. 18 is a copy (enlarged) of a microscope photograph of the alloy according to Example No. 4.

FIG. 16 through FIG. 18 illustrate the metallic structure of the alloy of Example No. 4 equivalent to the second invention. This alloy has a Cu-22% Ni-5% Fe-7.3% Co-2.9% Si-9.3% Mo-0.25% B-1.5% Cr composition. When the Cr content/B content is taken as an $\alpha$ value, it is $\alpha$=1.5%/0.25%=6. When B and Cr are contained compositely, as shown in FIG. 16 through FIG. 18, it is seen that the surfaces of the hard particles become smooth, and that the hard particles, which are close to circular shapes (spherical shapes), are formed.

Figure 19:
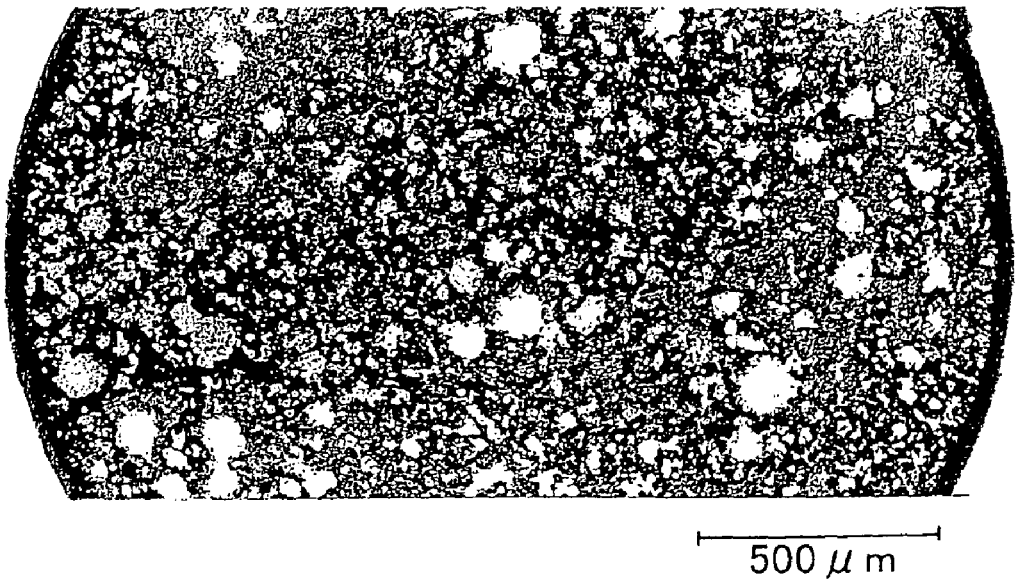
FIG. 19 is a copy of a microscope photograph of an alloy according to Comparative Example No. 5.
Figure 20:
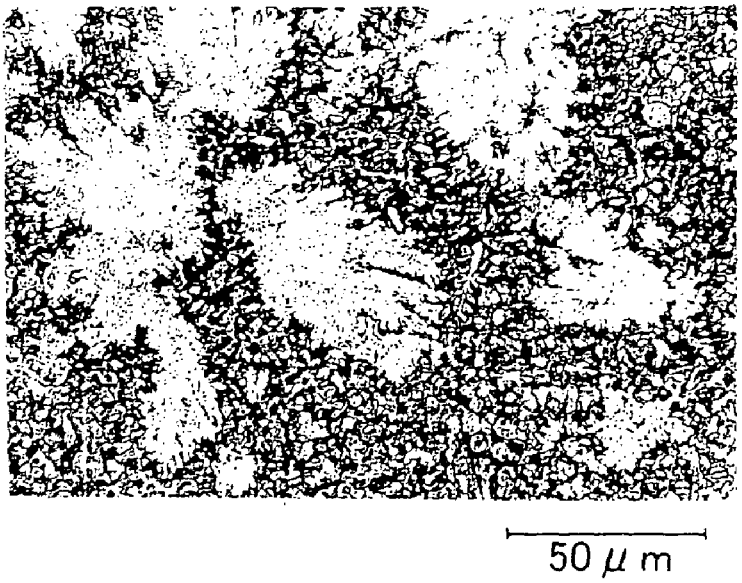
FIG. 20 is a copy (enlarged) of a microscope photograph of the alloy according to Comparative Example No. 5.

FIG. 19 and FIG. 20 illustrate the metallic structure of an alloy equivalent to Comparative Example No. 5 of the second invention. This alloy has a Cu-16% Ni-5% Fe-7.3% Co-2.9% Si-6.2% Mo-1.5% Cr composition, although it contains Cr, it does not contain B. As shown in FIG. 19 and FIG. 20, the hard particles are strangely-shaped, and remarkable irregularities are appreciated in the surfaces of the particles (the interfaces to the matrix).

Further, as Comparative Example No. 6, regarding No. 1, No. 3 and No. 6 set forth in Table 1 of aforementioned Patent Literature No. 3 (Japanese Unexamined Patent Publication (KOKAI) No. 4-131,341) as invented alloys, in the same manner as described above, using a 6-mm-outside-diameter and 2-mm-thickness pipe made of stainless (material quality SUS316), the 1,600-° C. molten metals were cast by suction, and were solidified to form test pieces according to Comparative Example No. 6. Regarding Comparative Example No. 6, when the structure was observed using an optical microscope, circle-shaped hard particles, or hard particles, which were close to circular shapes and whose interfaces were smooth, could not be obtained. In accordance with such hard particles, the large irregularities in the surfaces of the hard particles are likely to be the starting points of cracks, and it is inferred that the crack resistance is degraded than that of the present alloy.

Figure 21:
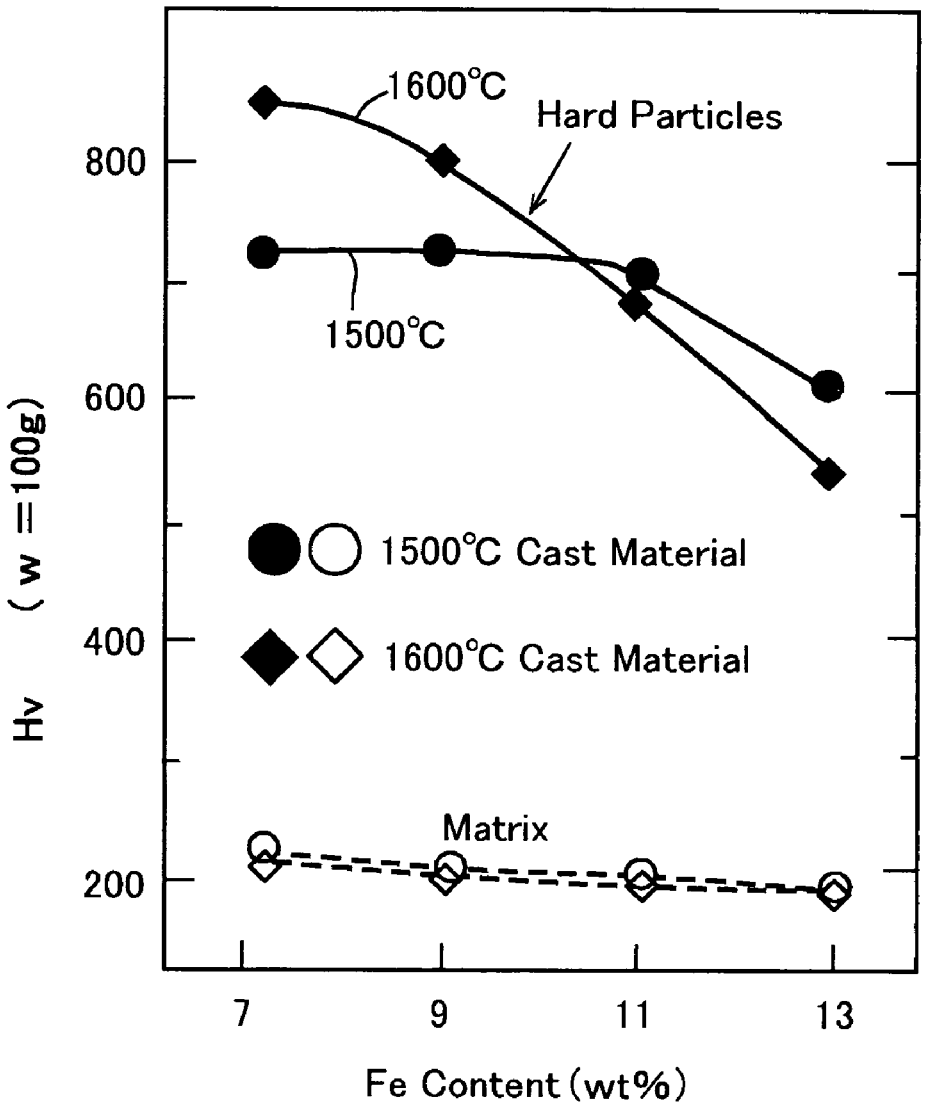
FIG. 21 is a graph, in regard to alloys equivalent to the comparative examples, for illustrating the relationship between the iron content and the Vickers hardness of hard particles, and simultaneously the relationship between the iron content and the Vickers hardness of matrices.

Regarding the alloy having the composition of the comparative example, the relationships among the Vickers hardness of the matrix at room temperature, the Vickers hardness of the hard particles at room temperature and the Fe content were tested (load: 100 g). FIG. 21 illustrates the test results according to an alloy having a composition equivalent to the comparative example which does not contain B and Cr. This alloy has a Cu-16.5% Ni-2.3% Si-8.5% Mo—Fe basic composition, and the Fe content is varied in a range of 7-13%. As shown in FIG. 21, as for the hardness of the hard particles in the cast material cast at 1,600° C., it fell within a range of Hv 820-Hv 500. Specifically, it is Hv 820 when being 7% Fe, is Hv 800 when being 9% Fe, and degraded close to Hv 500 when being 13% Fe.

Moreover, as shown in FIG. 21, as for the hardness of the hard particles in the cast material cast at 1,500° C., it fell within a range of Hv 720-Hv 600. Specifically, it is Hv 710 when being 7% Fe, is Hv 700 when being 9% Fe, and degraded close to Hv 600 when being 13% Fe. It is inferred that the hardness tendency of the hard particles differ between the cast material cast at 1,500° C. and the cast material cast at 1,600° C. because the granularities and dispersion states of the hard-phase fine particles in the hard particles differ or the respective elements' distribution amounts within the hard particles change slightly by temperatures.

As shown in FIG. 21, as for the hardness of the matrix, it is Hv 220-Hv 180 for both cast material cast at 1,500° C. and cast material cast at 1,600° C.

Figure 22:
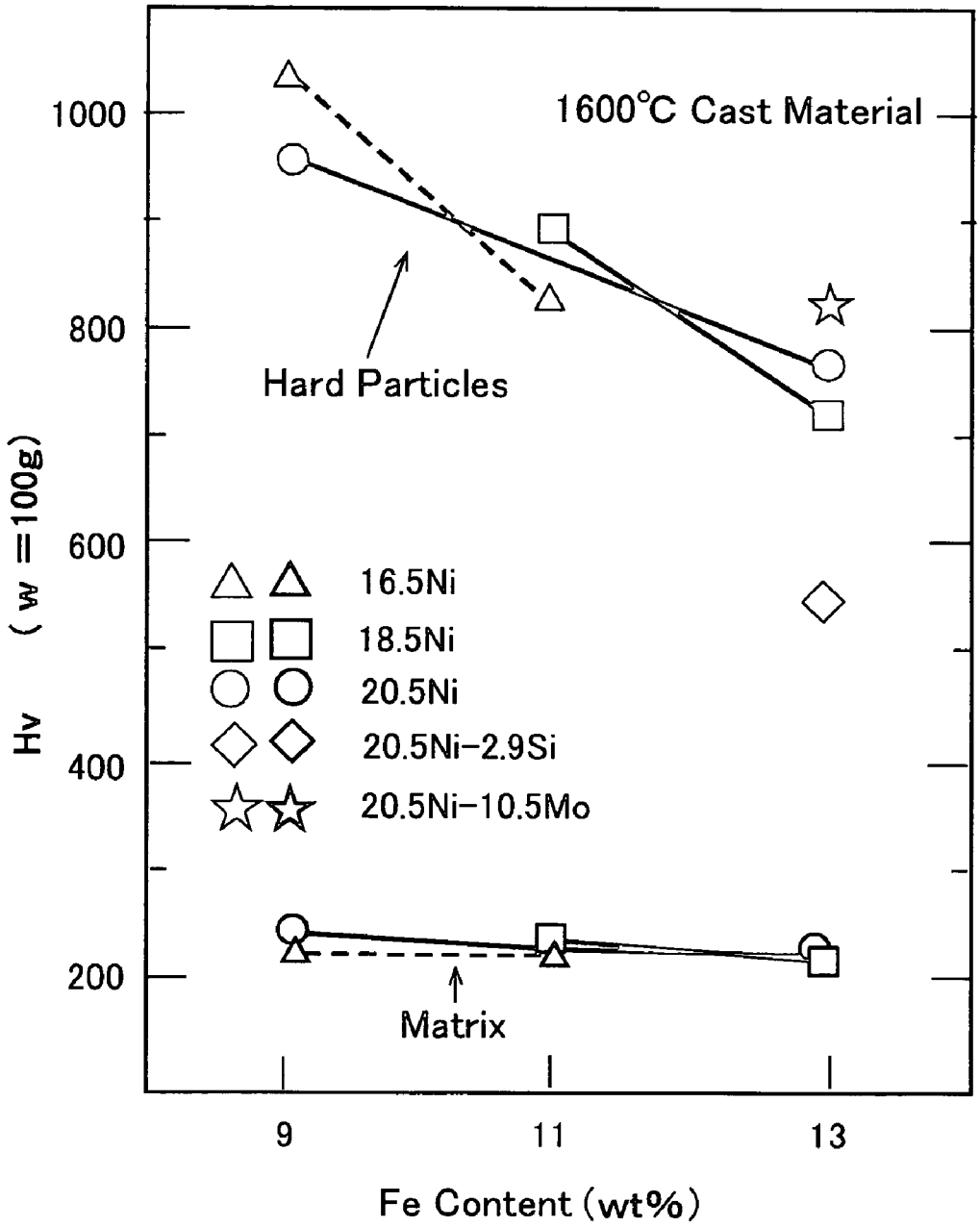
FIG. 22 is a graph, in regard to alloys equivalent to the examples, for illustrating the relationship between the iron content and the Vickers hardness of hard particles, and simultaneously the relationship between the iron content and the Vickers hardness of matrices.

Further, regarding the alloy having the compositions equivalent to the examples, the relationships among the Vickers hardness of the matrix at room temperature, the Vickers hardness of the hard particles at room temperature and the Fe content were tested (load: 100 g). In this instance, the alloys, whose Ni content, Ni—Si content and Ni—Mo content differed respectively, were used, and the Vickers hardness of the matrix and the Vickers hardness of the hard particles were found. FIG. 22 illustrates the test results. FIG. 22 is one which summarizes them, taking the horizontal axis as the Fe content. In this instance, Cu-16.5% Ni-2.3% Si-8.5% Mo-0.25% B-1.5% Cr—Fe is taken as the basic composition, and the Fe content is changed within a range of 9-13%. In this instance, when the Cr content/B content is taken as an $\alpha$ value, it is $\alpha$=1.5%/0.25%=6.

Since boron is mainly distributed within the hard particles, the hardness of the hard particles becomes higher than the hardness of the aforementioned alloy (FIG. 21), as can be understood from FIG. 22. Regarding the matrix, there hardly was any change, as can be understood from FIG. 22.

Further, regarding alloys having compositions set forth in Table 2 (No. a through No. p), in the same manner as described above, using the pipe made of stainless, the 1,600-° C. molten metals were cast by suction, and were solidified to form test pieces. When a microscopic observation was carried out onto these test pieces, it was found out that the surfaces of the hard particles became smooth so that the hard particles, which were close to circular shapes (spherical shapes), were formed.

TABLE 2

| | Alloy Composition Weight % | | | | | | | |
|---|---|---|---|---|---|---|---|---|
| | Ni | Fe | Si | Mo | B | Cr | Co | Cu |
| No. a | 18.5 | 13 | 2.3 | 8.5 | 0.25 | 1.5 | — | Balance |
| No. b | 20.5 | 9 | 2.3 | 8.5 | 0.25 | 1.5 | — | Balance |
| No. c | 20.5 | 13 | 2.3 | 8.5 | 0.25 | 1.5 | — | Balance |
| No. d | 20.5 | 13 | 2.3 | 10.5 | 0.25 | 1.5 | — | Balance |
| No. e | 16.5 | 11 | 2.3 | 8.5 | 0.25 | 1.5 | — | Balance |
| No. f | 18.5 | 11 | 2.3 | 8.5 | 0.25 | 1.5 | — | Balance |
| No. g | 18.5 | 13 | 2.3 | 8.5 | 0.25 | 1.5 | — | Balance |
| No. h | 20.5 | 13 | 2.3 | 8.5 | 0.25 | 1.5 | — | Balance |
| No. i | 20.5 | 13 | 2.9 | 8.5 | 0.25 | 1.5 | — | Balance |
| No. j | 20.5 | 13 | 2.3 | 10.5 | 0.25 | 1.5 | — | Balance |
| No. k | 22.5 | 9 | 2.3 | 8.5 | 0.25 | 1.5 | — | Balance |
| No. l | 22.5 | 13 | 2.3 | 8.5 | 0.25 | 1.5 | — | Balance |
| No. m | 24.5 | 9 | 2.3 | 8.5 | 0.25 | 1.5 | — | Balance |
| No. n | 20 | 5 | 2.9 | 9.3 | 0.125 | 1.5 | 7.3 | Balance |
| No. o | 20 | 5 | 2.9 | 9.3 | 0.25 | 1.5 | 7.3 | Balance |
| No. p | 22 | 5 | 2.9 | 9.3 | 0.25 | 1.5 | 7.3 | Balance |

Laser Build-Up Test

As representative examples, meltable materials, which were compounded to be the target compositions as designated at No. a through No. p of Table 2, were melted in vacuum, and atomized powders were made by spraying an argon gas. And, the atomized powders were used as powders for building up, built-up layers were formed on a cylinder head made of aluminum by laser beam ($CO_2$) irradiation, and laser-clad valve seats were formed. As for the testing conditions, the laser beam output was adapted to 3.5 kW, the focus diameter was adapted to 2.0 millimeters, the processing feed rate was adapted to 900 mm/min, and the shielding gas was adapted to an argon gas (10-liter/min flow rate). When the built-up layers were thus formed by building up with laser beam, it was confirmed that the crackability during building up was controlled and the crack resistance improved.

Others

In addition to above, the present invention is not limited to the examples alone, which are described above and illustrated in the drawings, but is one which can be carried out by appropriately performing modifications within a range not deviating from the gist.

INDUSTRIAL APPLICABILITY

The present invention can be utilized for build-up wear resistance copper alloys for which wear resistance is requested. Especially, it can be utilized for build-up wear-resistant copper alloys which are used for the inlet-side or exhaust-side valve seats of internal combustion engines using gasoline, diesel, natural gases, and the like, as the fuel. Among them, it can be utilized for build-up wear resistant copper alloys which are melted by laser beams and are then solidified.

The invention claimed is:

1. A build-up wear-resistant copper alloy, consisting of:

5.0-24.5% Ni, 3.0-20.0% Fe, 0.5-5.0% Si, 0.05-0.3% B, 0.3-5.0% Cr, 0.01-2.0% Co, an element selected from the group consisting of molybdenum, tungsten, vanadium, and a mixture thereof in an amount of 3.0-20.0%, by weight %, and a balance being copper and inevitable impurities, wherein a ratio of an amount of Cr to an amount of B is four or more.

* * * * *